US008042899B2

(12) United States Patent
Folkins et al.

(10) Patent No.: US 8,042,899 B2
(45) Date of Patent: Oct. 25, 2011

(54) SYSTEM AND METHOD FOR COMPENSATING FOR WEAK, INTERMITTENT, OR MISSING INKJETS IN A PRINTHEAD ASSEMBLY

(75) Inventors: Jeffrey J. Folkins, Rochester, NY (US); David A. Mantell, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 416 days.

(21) Appl. No.: 12/049,980

(22) Filed: Mar. 17, 2008

(65) Prior Publication Data

US 2009/0231375 A1 Sep. 17, 2009

(51) Int. Cl.
*B41J 29/38* (2006.01)

(52) U.S. Cl. ..... 347/10; 347/14

(58) Field of Classification Search ..... 347/10
See application file for complete search history.

(56) References Cited

U.S. PATENT DOCUMENTS

| | | | | |
|---|---|---|---|---|
| 3,946,398 | A | 3/1976 | Kyser et al. | |
| 4,907,013 | A | 3/1990 | Hubbard et al. | |
| 4,963,882 | A | 10/1990 | Hickman | |
| 5,581,284 | A | 12/1996 | Hermanson | |
| 5,640,183 | A | 6/1997 | Hackleman | |
| 6,215,557 | B1 | 4/2001 | Owens | |
| 6,695,435 | B1 | 2/2004 | Cheng et al. | |
| 6,739,690 | B1 | 5/2004 | Darling | |
| 7,075,677 | B1 * | 7/2006 | Silverbrook | 358/1.9 |
| 7,338,144 | B2 | 3/2008 | Mantell et al. | |
| 2005/0105105 | A1 | 5/2005 | Vestjens et al. | |
| 2005/0116981 | A1 | 6/2005 | Faken et al. | |
| 2006/0125850 | A1 * | 6/2006 | Kim et al. | 347/5 |
| 2006/0279591 | A1 * | 12/2006 | Lee | 347/9 |

* cited by examiner

*Primary Examiner* — Matthew Luu
*Assistant Examiner* — Brian Goldberg
(74) *Attorney, Agent, or Firm* — Maginot, Moore & Beck LLP

(57) ABSTRACT

A system enables surrounding inkjets to be used to compensate for missing, intermittent, or weak inkjets without requiring additional passes of the image substrate or slowing the printing process. The system includes a printhead firing signal generator configured to generate a plurality of inkjet firing signals with reference to a set of predetermined firing signal parameters, and a firing signal adjustment circuit configured to modify at least one predetermined firing signal parameter to increase a first mass of liquid ink ejected by an inkjet proximate a defective inkjet in response to a signal identifying the defective inkjet.

9 Claims, 4 Drawing Sheets

SYSTEM AND METHOD FOR COMPENSATING FOR WEAK, INTERMITTENT, OR MISSING INKJETS IN A PRINTHEAD ASSEMBLY

TECHNICAL FIELD

This disclosure relates generally to imaging devices that eject ink from inkjets onto an image substrate and, more particularly, to imaging devices that normalize the firing signals for inkjets to compensate for inkjet differences.

BACKGROUND

Drop on demand inkjet technology for producing printed media has been employed in commercial products such as printers, plotters, and facsimile machines. Generally, an inkjet image is formed by selectively ejecting ink drops from a plurality of drop generators or inkjets, which are arranged in a printhead or a printhead assembly, onto an image substrate. For example, the printhead assembly and the image substrate are moved relative to one other and the inkjets are controlled to emit ink drops at appropriate times. The timing of the inkjet activation is performed by a printhead controller, which generates firing signals that activate the inkjets to eject ink. The image substrate may be an intermediate image member, such as a print drum or belt, from which the ink image is later transferred to a print medium, such as paper. The image substrate may also be a moving web of print medium or sheets of a print medium onto which the ink drops are directly ejected. The ink ejected from the inkjets may be liquid ink, such as aqueous, solvent, oil based, UV curable ink or the like, which is stored in containers installed in the printer. Alternatively, the ink may be loaded in a solid form that is delivered to a melting device, which heats the solid ink to its melting temperature to generate liquid ink that is supplied to a print head.

Variations in inkjets may be introduced during print head manufacture and assembly. The variations include differences in physical characteristics, such as inkjet nozzle diameters, channel widths, or lengths, or differences in electrical characteristics, such as thermal or mechanical activation power for the inkjets. These variations may result in different volumes of ink being ejected from the inkjets in response to the same magnitude or same frequency firing signal. To compensate for these differences some previously known printers perform a process to normalize the firing signal for each inkjet within a printhead. Thus, normalizing the electrical firing signals that are used to activate individual inkjets enable all of the inkjets in a printhead to generate ink drops having substantially the same drop mass.

Another issue that arises during operation of an inkjet printer is intermittent, weak, or missing inkjets. Specifically, some inkjets fail either completely or partially so they no longer perform as expected to eject ink onto an image substrate. A method for compensating for such inkjets is disclosed in U.S. Pat. No. 7,021,739 to Burke et al. and which is assigned to the assignee of the present application. The method disclosed in that patent disables the inoperative inkjet and uses surrounding inkjets to compensate for the missing, intermittent, or weak inkjet. The printing to be done by the disabled inkjet is performed by one or more of the surrounding inkjets on one or more additional image substrate passes. Thus, this approach slows the printing process because additional substrate passes are required.

SUMMARY

A system enables surrounding inkjets to be used to compensate for missing, intermittent, or weak inkjets without requiring additional passes of the image substrate or slowing the printing process. The system includes a printhead firing signal generator configured to generate a plurality of inkjet firing signals with reference to a set of predetermined firing signal parameters, and a firing signal adjustment circuit configured to modify at least one predetermined firing signal parameter to increase a first mass of liquid ink ejected by an inkjet proximate a defective inkjet in response to a signal identifying the defective inkjet.

A method is also disclosed below that enables surrounding inkjets to be used to compensate for missing, intermittent, or weak inkjets. The method includes generating a plurality of inkjet firing signals in accordance with a plurality of predetermined firing signal parameters, and modifying at least one of the predetermined firing signal parameters to increase the first amount of liquid ink ejected by an inkjet proximate a defective inkjet in response to a signal identifying the defective inkjet.

BRIEF DESCRIPTION OF THE DRAWINGS

The foregoing aspects and other features of a printer that adjusts firing signal parameters for generating inkjet firing signals for inkjets near a defective inkjet are explained in the following description, taken in connection with the accompanying drawings, wherein.

DETAILED DESCRIPTION

Figure 1:
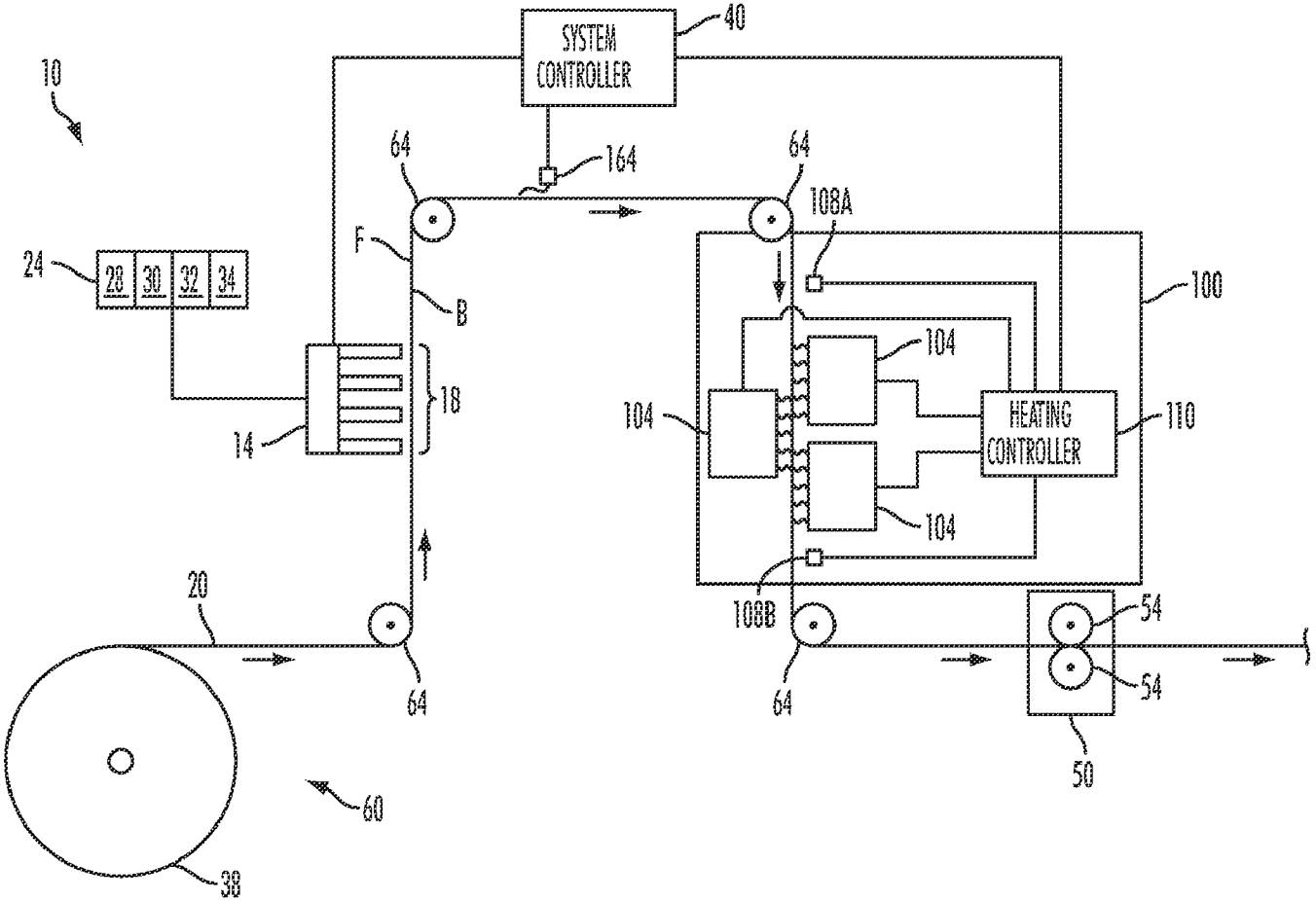
FIG. 1 PRIOR ART
FIG. 1 is a block diagram of an inkjet printing system in which a system and method that compensate for weak, intermittent, or missing inkjets may be used.

For a general understanding of the environment for the system and method disclosed here as well as the details for the system and method, reference is made to the drawings. In the drawings, like reference numerals have been used throughout to designate like elements.

FIG. 1 depicts an imaging apparatus, or at least a portion of an imaging apparatus, 10 in which elements pertinent to the present disclosure are shown. In the embodiment shown, the imaging apparatus 10 implements a solid ink print process for printing onto a continuous media web. To this end, the imaging device 10 includes a web supply and handling system 60, a phase change ink printing system 16, and a web heating system 100. Although the inkjet compensation system and method are described below with reference to the imaging system depicted in FIG. 1, the inkjet compensation system and method may be used in any imaging apparatus that uses inkjets to eject ink onto an image substrate.

As shown in FIG. 1, the phase change ink printing system includes a web supply and handling system 60, a printhead assembly 14, a web heating system 100, and a fixing assembly 50. The web supply and handling system 60 may include one or more media supply rolls 38 for supplying a media web 20 to the imaging device. The supply and handling system is configured to feed the media web in a known manner along a media pathway in the imaging device through the print zone 18, past the web heating system 100, and through the fixing assembly 50. To this end, the supply and handling system 60 may include any suitable device 64, such as drive rollers, idler rollers, tensioning bars, etc., for moving the media web through the imaging device. The system may include a take-up roll (not shown) for receiving the media web 20 after printing operations have been performed. Alternatively, the media web 20 may be fed to a cutting device (not shown) as is known in the art for cutting the media web into discrete sheets.

The printhead assembly 14 is appropriately supported to eject drops of ink directly onto the media web 20 as the web moves through the print zone 18. In other imaging systems in which the compensation system and method may be used, the printhead assembly 14 may be configured to eject drops onto an intermediate transfer member (not shown), such as a drum or belt, for subsequent transfer to a media web or media sheets. The printhead assembly 14 may be incorporated into either a carriage type printer, a partial width array type printer, or a page-width type printer, and may include one or more printheads. As illustrated, the printhead assembly includes four page-width printheads for printing full color images comprised of the colors cyan, magenta, yellow, and black. Within each printhead, a plurality of inkjets is arranged in a row and column fashion. Each of the inkjets is coupled to a source of liquid ink and each one ejects ink through an inkjet nozzle in response to a firing signal being received by an inkjet actuator, such as a piezoelectric actuator, in the inkjet.

In the printing system shown in FIG. 1, ink is supplied to the printhead assembly from a solid ink supply 24. In aqueous or emulsion ink systems, which use the compensating system and method disclosed herein, however, the liquid ink is stored in one or more volumetric containers installed in the printing system. Since the phase change ink imaging device 10 is a multicolor device, the ink supply 24 includes four sources 28, 30, 32, 34, representing four different colors CYMK (cyan, yellow, magenta, black) of phase change ink solid ink. The phase change ink system 24 also includes a solid phase change ink melting and control assembly or apparatus (not shown) for melting or phase changing the solid form of the phase change ink into a liquid form, and then supplying the liquid ink to the printhead assembly 14.

Once the drops of ink have been ejected by the printhead assembly onto the moving web to form an image, the web is moved through a fixing assembly 50 for fixing the emitted ink drops, or image, to the web. In the embodiment of FIG. 1, the fixing assembly 50 comprises at least one pair of fixing rollers 54 that are positioned in relation to each other to form a nip through which the media web is fed. The ink drops on the media web are pressed into the web and spread out on the web by the pressure formed by the nip. Although the fixing assembly 50 is depicted as a pair of fixing rollers, the fixing assembly may be any suitable type of device or apparatus, as is known in the art, which is capable of fixing an ink image onto the media.

Operation and control of the various subsystems, components and functions of the device 10 are performed with the aid of a controller 40. The controller 40 may be a processor configured to perform the defective inkjet compensation process and operate the inkjet adjustment circuit described below. The controller may be a general purpose processor having an associated memory in which programmed instructions are stored. Execution of the programmed instructions enables the controller to generate firing signals for inkjets, to receive a signal identifying one or more defective inkjets with a row identifier and a column identifier for each defective inkjet, and to implement an appropriate adjustment for one or more neighboring inkjets. The controller may, alternatively, be an application specific integrated circuit or a group of electronic components configured on a printed circuit for operation of the inkjet compensation system. Thus, the controller may be implemented in hardware alone, software alone, or a combination of hardware and software. In one embodiment, the controller 40 comprises a self-contained, microcomputer having a central processor unit (not shown) and electronic storage (not shown). The electronic storage may be a non-volatile memory, such as a read only memory (ROM) or a programmable non-volatile memory, such as an EEPROM or flash memory. The controller 40 is configured to orchestrate the production of printed or rendered images in accordance with image data received from the image data source (not shown). The image data source may be any one of a number of different sources, such as a scanner, a digital copier, a facsimile device, etc. Pixel placement control is exercised relative to the media web 20 in accordance with the print data, thus, forming desired images per the print data as the media web is moved through the print zone.

As part of a setup or maintenance routine, each printhead of the printhead assembly 14 may undergo a normalization process as is known in the art to ensure that each inkjet of a printhead ejects ink drops having substantially the same print quality. Print quality of drops ejected from the printheads may be related to a number of drop parameters such as, for example, mass, velocity, and intensity. Processes for measuring or detecting print quality parameters such as mass, velocity, and intensity of emitted ink drops are known. Once a print quality parameter has been detected, or measured, for each inkjet of a printhead, a determination may be made whether the print quality parameter of each inkjet meets predetermined ink drop criteria. If the drop parameter does not meet the predetermined ink drop criteria, such as the ink drop mass is outside of a specified mass range, the inkjets may be calibrated to return the ink drop to the predetermined ink drop criteria. For example, the voltage level, amplitude, and/or timing of one or more segments, or pulses, of the firing signals may be selectively varied to adjust the print quality of drops emitted by each inkjet. The normalized parameters for generating the firing signals may be saved in memory for the respective printhead controller to access. Once the firing signal parameters for generating inkjet firing signals have been normalized for each printhead, the normalized firing signal parameters may be recorded or stored for each printhead controller so that the normalized firing signal parameters may be used to subsequently fire the inkjets. Alternatively, a plurality of predetermined firing signal parameters may be stored for the generation of the inkjet firing signals prior to operation of the printer. As used herein, predetermined firing signal parameters refers to a priori firing signal parameters and to normalized firing signal parameters. These predetermined firing signal parameters are used by a printhead signal generator to generate the inkjet firing signals that cause inkjets within a printhead to eject ink.

In one exemplary embodiment, the printing system 10 may include a drop intensity sensor for detecting an intensity of drops ejected by the inkjets. The drop intensity sensor may comprise a light emitting diode (LED) for directing light onto drops ejected onto an image receiving surface, and a light detector, such as a CCD sensor, for detecting an intensity of light reflected from drops emitted by each inkjet. Thus, a drop intensity value may be detected that corresponds to each inkjet. The detected drop intensity value for each inkjet of a printhead may be compared to a predetermined threshold value or range to determine if each inkjet is ejecting drops of the specified intensity. If the drop intensity of an inkjet does not meet the desired intensity level, a firing signal adjustment may be performed by the system as discussed below In another embodiment, the system 10 may include a defective inkjet detector, such as those described in U.S.

Publication Number 2006/0114284 to Mizes et al. This printed patent application, which was filed on Nov. 30, 2004, has been assigned U.S. Ser. No. 10/999,014, and is owned by the assignee of this application, is hereby expressly incorporated herein in its entirety by reference. Of course, other defective inkjet detectors may be used. The defective inkjet detector generates a signal that identifies each defective inkjet position within a printhead. A defective inkjet, as used herein, refers to an inkjet that does not eject any ink in response to a firing signal, consistently ejects less ink that expected for the magnitude of the firing signal, or that responds to a firing signal by ejecting the corresponding volume of ink on an intermittent basis. The inkjet identifying data are used as described below to identify neighboring or near neighboring inkjets in the vicinity of the defective inkjet. Thereafter, images that include the defective inkjet firing a drop of ink result in one or more inkjets in the vicinity of the defective inkjet to have their firing signal modified to increase the amount of ink ejected by the inkjet. As a consequence, the one or more proximate inkjets eject more ink than otherwise required for forming an ink image. The additional ink helps obscure from the eye of a human observer the missing or lighter pixel caused by the defective inkjet.

Figure 2:
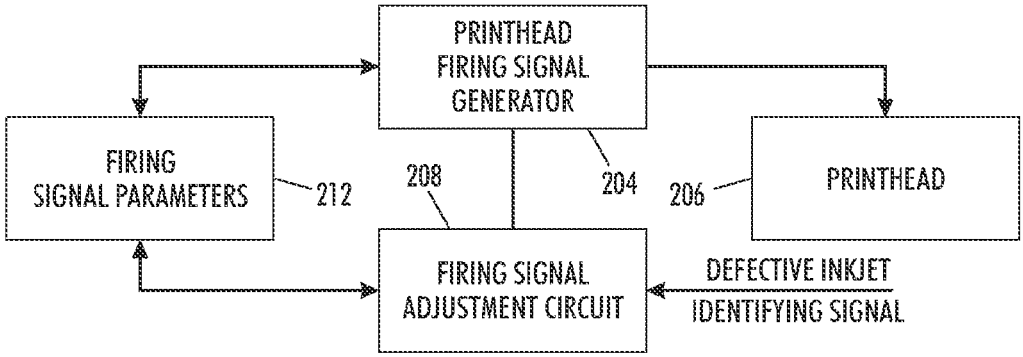
FIG. 2 is a block diagram of a system that compensates for weak, intermittent, or missing inkjets in an inkjet imaging system.

A block diagram of a system that compensates for missing, intermittent, or weak inkjets is shown in FIG. 2. The system 200 includes a printhead firing signal generator 204 that is configured to generate a plurality of inkjet firing signals for the inkjets within a printhead 206. The firing signals are generated with reference to a plurality of firing signal parameters stored in a memory 212. Among the firing signal parameters stored in the memory 212 are a maximum voltage for a firing signal, a timing sequence for the firing signal, and other known parameters that affect the ejection of ink by an inkjet. The firing signal generator is also electrically coupled to a firing signal adjustment circuit 208, which is also coupled to the memory 212 in which the firing signal parameters are stored. The firing signal adjustment circuit is configured to modify a firing signal parameter and/or a inkjet firing signal for an inkjet to increase the amount of ink ejected by an inkjet in response to the firing signal adjustment circuit 208 receiving a signal identifying a defective inkjet. For example, the first signal adjustment circuit may increase the maximum voltage for an inkjet firing signal. The additional voltage enables the printhead firing signal generator 204 to generate a firing signal that causes the inkjet to eject additional ink. The additional ink in the vicinity of the missing, intermittent, or weak inkjet helps compensate for the ink not provided by the defective inkjet. Alternatively or additionally, a pixel to be printed by a defective inkjet may be diverted to an inkjet proximate the defective pixel. In this scenario, the firing signal for the proximate inkjet is increased from what it would be if the defective inkjet was operational to a firing signal that causes the proximate inkjet to eject ink for the pixel that otherwise would have been ejected by the defective inkjet. In another embodiment, the firing signal adjustment circuit 208 increases the firing signals for a plurality of inkjets proximate to the defective inkjet to compensate for the pixel of ink that was to be printed by the defective inkjet.

As noted previously, methods for normalizing inkjets prior to commencing operation of a printing device are known. The printhead firing signal generator 204 implements one of these known methods and stores the normalized firing signal parameters in the memory 212. The stored parameters include a first voltage value for the maximum voltage of the firing signal, a timing sequence for the firing signal, and other known firing signal parameters. The first voltage value is less than the full scale voltage that may be used to fire an inkjet. In one embodiment, the first voltage is approximately 67 percent of the full scale voltage for firing an inkjet. Because the maximum voltage for a firing signal is less than the full scale voltage for firing the inkjet, the inkjet does not generate an ink drop with the largest mass possible from the inkjet. After normalization, the maximum voltage is associated with the largest pixel value in an image to be generated by the printing system in which the system 200 is installed.

In response to a signal from an inkjet detector that identifies a defective inkjet, the firing signal adjustment circuit 208 modifies one of the predetermined firing signal parameters to increase the amount of ink ejected by an inkjet. For example, the adjustment circuit 208 may increase the maximum voltage for at least one inkjet that neighbors an identified defective inkjet to a second voltage. This extension to the voltage range enables the printhead firing signal generator 204 to generate firing signals having a voltage that is greater than the first voltage level. The higher voltage causes an ink drop with a larger mass to be generated by the inkjet. In one embodiment, the firing signal adjustment circuit 208 modifies at least one predetermined firing signal parameter for a plurality of inkjets neighboring the defective inkjet. Neighboring inkjets are those inkjets that are adjacent to a defective inkjet in the inkjet array within a printhead. Near-neighboring inkjets are those inkjets are those inkjets that are adjacent the neighboring inkjets.

The firing signal generator is configured to generate subsequent firing signals for proximate inkjets that have had their corresponding firing signal parameters modified. In the generation of the firing signal, the firing signal generator adds a compensation value to a firing signal for an inkjet to be fired to compensate for a defective inkjet. If the defective inkjet has an image pixel value, the firing signals for the neighboring inkjets may all be generated with reference to the compensation value. The additional ink mass ejected from the inkjets by the firing signals is generated with reference to the compensation value and the modified firing signal parameters.

Figure 3:
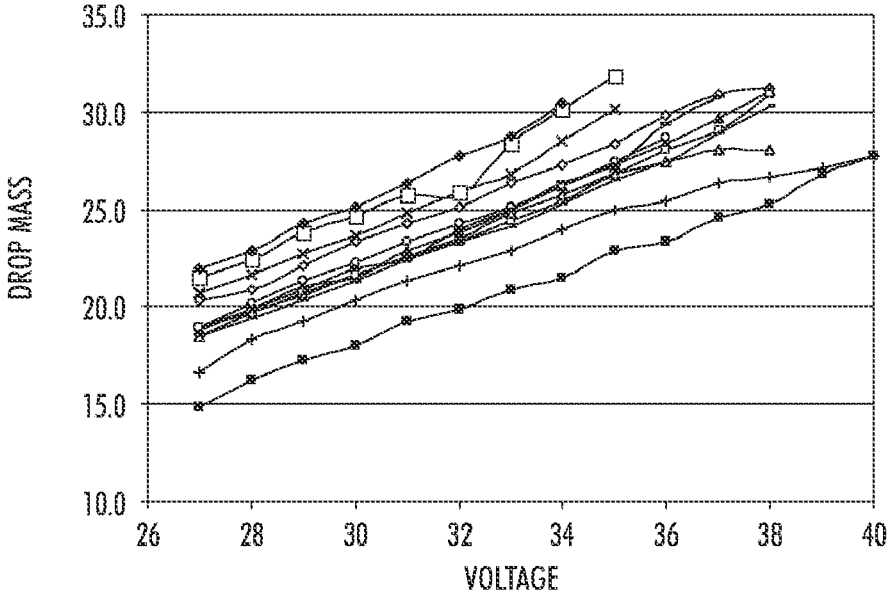
FIG. 3 is a graph of ink drop mass ejected from an inkjet as a function of a firing signal voltage.
Figure 4:
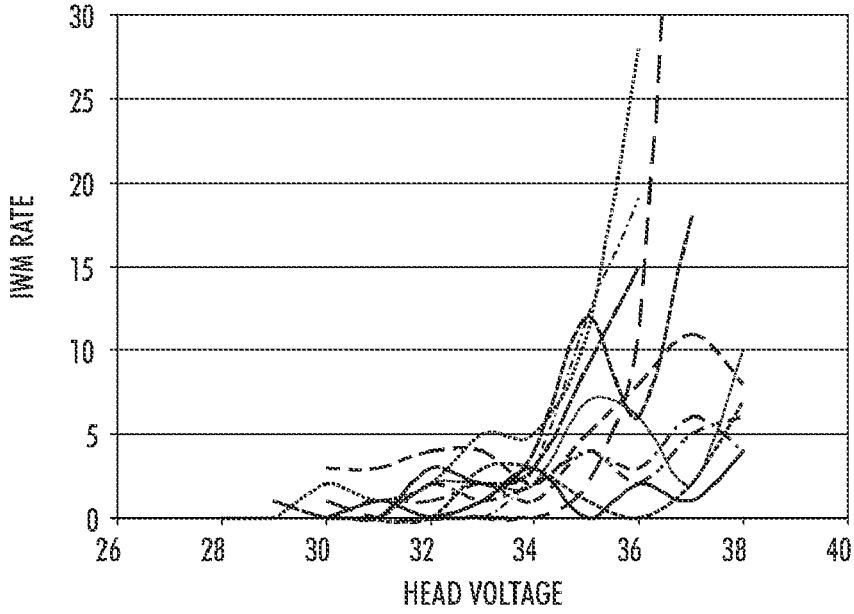
FIG. 4 is a graph of the probability that an inkjet fails as a function of a firing signal voltage.

One issue that arises from increasing the maximum voltage for an inkjet is an increased probability that an inkjet subsequently becomes defective. As shown in FIG. 3, the drop mass ejected by an inkjet generally increases linearly with increasing voltage. FIG. 4, however, shows that the rate of an inkjet becoming defective (Intermittent, Weak, or Missing (IWM) rate) varies non-linearly with an increase in the firing signal voltage, especially at the upper end of the firing signal voltage range. To reduce the likelihood that firing signals are generated with a voltage within a rapidly increasing portion of the IWM rate curve, the maximum voltage may be held to some predetermined limit. In one embodiment, the firing signal adjustment circuit 208 increases the maximum voltage of an inkjet neighboring a defective inkjet to a second voltage level that is approximately 85 percent of the full scale voltage for an inkjet.

In another embodiment, the predetermined firing signal parameters limit the generation of the inkjet firing signals by the printhead firing signal generator to inkjet firing signals that are approximately 90 percent or less of a full ink mass firing signal. A full ink mass firing signal is an inkjet signal that causes an inkjet to eject the largest amount of ink that can be ejected by the inkjet. In this embodiment, the firing signal adjustment circuit modifies an inkjet firing signal from the signal generated in accordance with the predetermined firing signal parameters to an inkjet firing signal that is in a range of approximately 90 percent to 100 percent of the full ink mass firing signal.

Figure 5:
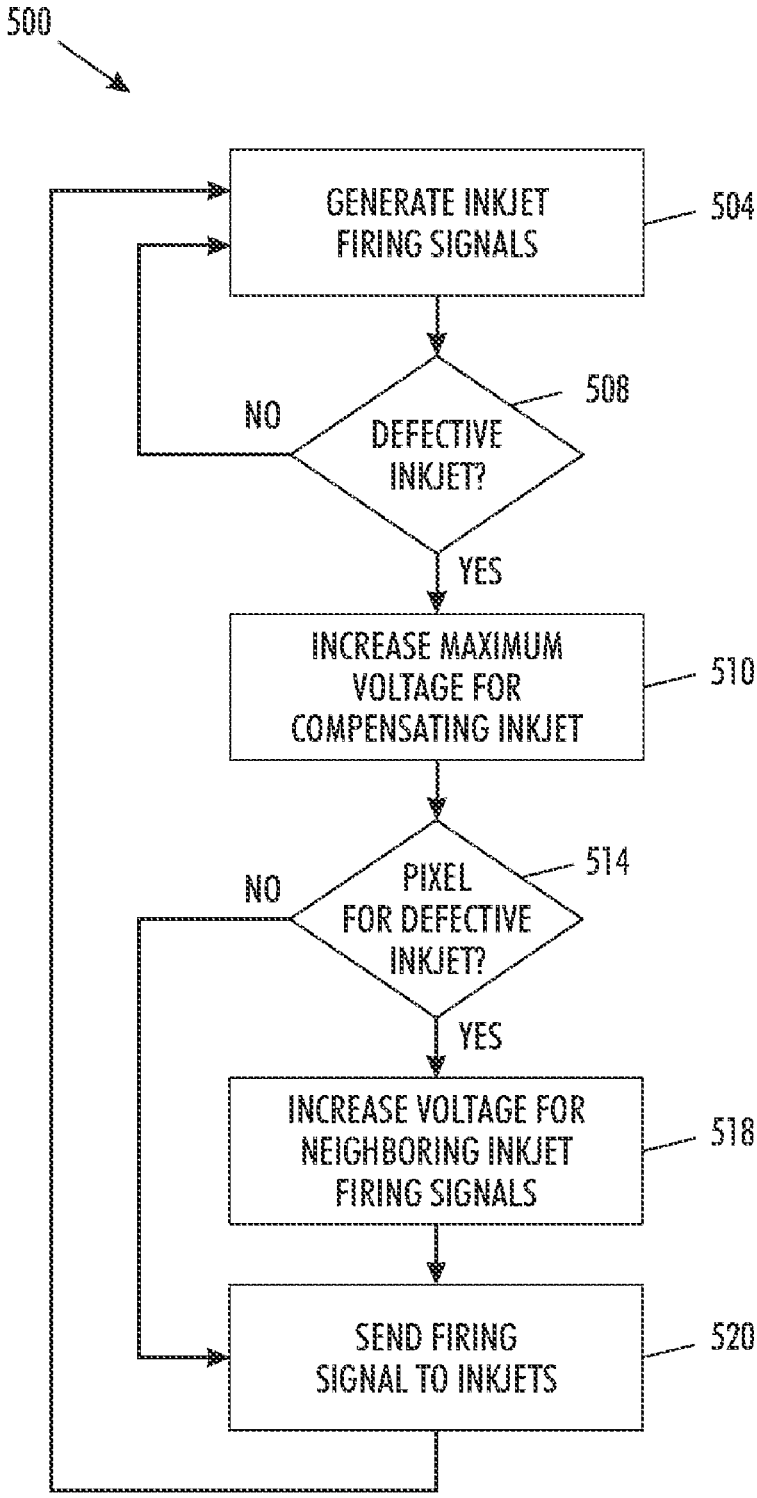
FIG. 5 is a flow diagram of a method that compensates for weak, intermittent, or missing inkjets in an inkjet imaging system.

A method for controlling a printhead to compensate for missing, intermittent, or weak inkjets is shown in FIG. 5. The method 500 includes generating a plurality of inkjet firing signals (block 504). The firing signals are generated with reference to a plurality of firing signal parameters. For example, the maximum voltage for a firing signal may correspond to a first voltage limit that is less than a full scale voltage for firing an inkjet. Upon receipt of a signal identifying a defective inkjet (block 508), at least one firing signal parameter is modified to enable the generated firing signal to increase the amount of ink ejected by an inkjet proximate a defective inkjet (block 510). To continue the example, the maximum voltage value may be increased to a second voltage limit for at least one inkjet proximate the defective inkjet. The signal identifying the defective inkjet identifies the printhead in which the defective inkjet is located and the position of the inkjet in the printhead. Upon detection of an image pixel to be ejected by the defective inkjet (block 514), firing signals are generated for the inkjets that had their firing signal parameters modified (block 518). In the example being discussed, the maximum voltage for the generated firing signals is increased to the second level. The firing signals are sent to inkjets to eject ink (block 520). The resulting increased ink drop masses ejected from the compensating inkjets help obscure the failure of the defective inkjet. While the method has been described with reference to modification of a firing signal maximum voltage, other predetermined firing signal parameters may be modified to compensate for a defective inkjet. In one embodiment of the method described above, the maximum voltage for a plurality of neighboring inkjets is increased. As noted above, the inkjets proximate to the identified defective inkjet may include neighboring inkjets and/or near-neighboring inkjets.

The method of FIG. 5 may also include processing that adjusts one or more inkjet firing signals from the range limited by the predetermined firing signal parameters to a range that is closer to a full ink mass firing signal. For example, the generation of the inkjet firing signals may be limited to a range of approximately 90 percent or less of a full ink mass firing signal. The adjustment may include modifying an inkjet firing signal from the signal generated in accordance with the predetermined firing signal parameters to an inkjet firing signal that is in a range of approximately 90 percent to 100 percent of the full ink mass firing signal. Additionally or alternatively, the inkjet firing signal adjustment may compensate for a pixel to be printed by the defective inkjet. This type of adjustment includes increasing an inkjet firing signal for a single inkjet proximate the defective inkjet to cause the proximate inkjet to print the pixel that otherwise would be printed by the defective inkjet or increasing the inkjet firing signals for a plurality of inkjets proximate the defective inkjet. The sum of the increases for the plurality of inkjet firing signals approximates the inkjet firing signal that would have been generated for the defective inkjet to print the pixel.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A method for controlling a printhead to compensate for missing, intermittent, or weak inkjets comprising:

generating a plurality of inkjet firing signals for at least one inkjet in a printhead with reference to a plurality of predetermined firing signal parameters to enable the at least one inkjet to eject a first amount of liquid ink, one of the predetermined firing signal parameters being a maximum voltage that is approximately 67 percent of a full scale voltage; and increasing the maximum voltage in the predetermined firing signal parameters for the at least one inkjet to a level that is less than approximately 85 percent of the full scale voltage to increase an amount of liquid ink ejected by the at least one inkjet in the printhead from the first amount to a second amount that is greater than the first amount in response to a signal identifying a defective inkjet proximate to the at least one inkjet.

2. The method of claim 1 wherein the maximum voltage is increased for a neighboring inkjet.

3. The method of claim 1 wherein the maximum voltage is increased for a near-neighboring inkjet.

4. The method of claim 1 wherein the plurality of predetermined firing signal parameters limit the generation of the inkjet firing signals to produce inkjet firing signals that are approximately 90 percent or less of a full ink mass firing signal; and the method further comprises:

modifying the inkjet firing signal parameters to enable the inkjet firing signals for the at least one inkjet to be generated in a range of approximately 90 percent to 100 percent of the full ink mass firing signal for the at least one inkjet.

5. The method of claim 1 further comprising:

generating one of the inkjet firing signals for the at least one inkjet with reference to the increased maximum voltage to operate the at least one inkjet proximate the defective inkjet and eject a pixel of ink for the defective inkjet.

6. The method of claim 1 further comprising:

modifying the plurality of inkjet firing signals with reference to the increased maximum voltage to operate a plurality of inkjets proximate to the defective inkjet and eject ink for a pixel to be ejected by the defective inkjet.

7. The method of claim 1, the generation of inkjet firing signals includes:

generating inkjet firing signals having a timing sequence that corresponds to a timing sequence stored in the plurality of predetermined firing signal parameters, the inkjet firing signals operating the at least one inkjet proximate the defective inkjet to eject a first amount of ink; and modifying the timing sequence stored in the plurality of predetermined firing signal parameters in response to the signal identifying the defective inkjet to enable the generation of an inkjet firing signal that operates the at least one inkjet proximate the defective inkjet to eject a second amount of ink, the second amount of ink being greater than the first amount of ink.

8. The method of claim 1, the increasing of the maximum voltage for the at least one inkjet includes:

increasing the maximum voltage for a plurality of inkjets proximate the defective inkjet.

9. The method of claim 1, the increasing of the maximum voltage includes:

increasing the maximum voltage for an inkjet in a printhead other than the printhead in which the defective inkjet is located.

* * * * *